US012329229B2

(12) United States Patent
Everitt-Penhale

(10) Patent No.: US 12,329,229 B2
(45) Date of Patent: Jun. 17, 2025

(54) HELMET

(71) Applicant: Haydn Clive Everitt-Penhale, Camp's Bay (CA)

(72) Inventor: Haydn Clive Everitt-Penhale, Camp's Bay (CA)

( * ) Notice: Subject to any disclaimer, the term of this patent is extended or adjusted under 35 U.S.C. 154(b) by 0 days.

(21) Appl. No.: 18/845,187

(22) PCT Filed: Feb. 14, 2023

(86) PCT No.: PCT/ZA2023/050009
§ 371 (c)(1),
(2) Date: Sep. 9, 2024

(87) PCT Pub. No.: WO2023/173146
PCT Pub. Date: Sep. 14, 2023

(65) Prior Publication Data

US 2025/0098807 A1 Mar. 27, 2025

(30) Foreign Application Priority Data

Mar. 7, 2022 (ZA) ..... 2022/02685

(51) Int. Cl.
*A42B 3/32* (2006.01)
*A42B 3/08* (2006.01)

(52) U.S. Cl.
CPC ..... *A42B 3/08* (2013.01)

(58) Field of Classification Search
CPC ..... A42B 3/326; A42B 3/205; A42B 3/222; A42B 3/08
See application file for complete search history.

(56) References Cited

U.S. PATENT DOCUMENTS 3,447,163 A 6/1969 Bothwell et al.
4,885,806 A * 12/1989 Heller ..... A42B 3/326 2/424

(Continued)

FOREIGN PATENT DOCUMENTS

CN 103054254 A 4/2013
EP 0797935 B1 9/1999

(Continued)

OTHER PUBLICATIONS

"International Search Report and Written Opinion mailed Mar. 9, 2023 in PCT Application No. PCT/ZA2023/050009".

*Primary Examiner* — Tajash D Patel
(74) *Attorney, Agent, or Firm* — Billion & Armitage

(57) ABSTRACT

A helmet includes a shell, a chin guard, a runner on the chin guard and a connector. The connector pivotally secures the chin guard to the shell and includes: (i) a track that: is sized to permit the chin guard runner to travel there along; and is rotatably connected to the shell about an axis of rotation, such that the track is able to rotate relative to the shell through at least 120 degrees between an operative position and a stowed position; (ii) a retainer at or near a first axial end of the track, which retainer is movable between: an inactive condition, in which the retainer permits a runner that is located at the first axial end of the track to move towards the second axial end of the track; and an active condition, in which the retainer prevents a runner that is located at the first axial end of the track from moving towards the second axial end of the track; and (iii) a formation that configures the retainer from: the inactive condition to the active condition when the track is rotated from either the operative position or the stowed position; and the active condition to the inactive condition when the track is in the operative position or the stowed position.

7 Claims, 6 Drawing Sheets

(56) References Cited

U.S. PATENT DOCUMENTS

| | | | | |
|---|---|---|---|---|
| 5,093,939 | A * | 3/1992 | Noyerie | A42B 3/326 2/424 |
| 2002/0129440 | A1 | 9/2002 | Hong et al. | |
| 2007/0136934 | A1 | 6/2007 | Kim et al. | |
| 2009/0100576 | A1 | 4/2009 | Kim | |
| 2016/0015114 | A1 | 1/2016 | Berthier et al. | |
| 2018/0213877 | A1 | 8/2018 | Liao et al. | |

FOREIGN PATENT DOCUMENTS

| | | | | |
|---|---|---|---|---|
| EP | 2478785 | B1 | 6/2014 | |
| EP | 3001919 | A1 | 4/2016 | |
| EP | 3190913 | B1 | 4/2019 | |
| GB | 1018928 | A | 2/1966 | |
| GB | 1452627 | A | 10/1976 | |
| WO | 2006045912 | A1 | 5/2006 | |
| WO | 2006128833 | A1 | 12/2006 | |
| WO | WO-2010016032 | A2 * | 2/2010 | A42B 3/326 |
| WO | 2013021264 | A1 | 2/2013 | |
| WO | 2014163404 | A1 | 10/2014 | |
| WO | WO-2023191281 | A1 * | 10/2023 | |

* cited by examiner

HELMET

BACKGROUND

The present invention relates to a helmet. More specifically, the present invention relates to a helmet with a chin guard that it rotatably secured to the shell. Even more specifically, the present invention relates to a helmet with a chin guard that is independently rotatable and translatable relative to the shell.

Helmets with chin guards that translate relative to the shell are known. For instance, DE102014218041 describes a helmet wherein the chin guard includes a slider to translate the chin guard relative to the shell.

Helmets with chin guards that rotate relative to the shell are also known. For instance, WO2013/021264 "Modular helmet protection" describes a helmet wherein the chin guard is pivotally connected to the shell.

It is even known for helmets to include chin guards that synchronously rotate and translate relative to the shell. For instance:

- EP3,001,919 "Helmet for motorcycling" describes a helmet wherein a pivot pin on the shell is slidably captured by a track defined by the chin guard.
- US2002/0129440 "Jaw protection apparatus of helmet" describes a helmet shell and chin guard linked by a pair of pivot points associated with each other by a planetary gear.
- US2016/0015114 "Protective helmet with moveable chin guard with automatic shield lifting mechanism" describes a helmet wherein both the shell and the chin guard defines a track within which a common pivot pin is slidably captured.
- US2009/0100576 "Apparatus for opening/closing chin protection bar of safety helmet and safety helmet having the same", WO2006/128833 "Mobile protective helmet with mobile visor", CN101991208 and CN103054254 describe a helmet with a chin guard that is connected to the shell via a pair of pivot pins that are slidably captured within their respective tracks.
- US2007/0136934 "Device for opening-closing jaw guard of helmet" and WO2006/045912 "Protective helmet with movable chin guard, which is particularly suitable for motorcycling" describe a helmet wherein the chin guard is connected to the shell via: a first pivot pin that is fixed relative to the helmet shell; a second pivot pin that is slidable along a track; and a link arm connecting the two pivot pins, which link arm defines a track within which the first pivot pin is slidably captured.
- EP0797935 "Integral helmet for motorcyclists and the like provided with a device for opening-closing the chin-strap" describes a helmet wherein the chin guard is secured to the shell via: a first pair of pivot pins connected by a link arm; and a second pair of pivot pins connected by a link arm, wherein one of the pivot pins is slidably captured within a track.
- US2018/0213877 "Helmet with transformable jaw protecting structure based on gear constraint" describes a helmet wherein: the chin guard is connected to the shell via a pivot pin that is slidably movable along an arcuate groove; and a mechanism that induces movement of the pivot pin along the groove upon rotation of the pivot pin.

It is an object of the present invention to provide a new mechanism that permits independent rotation and translation of the chin guard relative to the helmet shell.

SUMMARY OF THE INVENTION

According to a preferred embodiment of the invention, there is provided a helmet that includes:

- a shell;
- a chin guard;
- a runner on the chin guard; and
- a connector for pivotally securing the chin guard to the shell, the connector including:
  - a track that:
    - is sized to permit the chin guard runner to travel there along; and
    - is rotatably connected to the shell about an axis of rotation, such that the track is able to rotate relative to the shell through at least 120 degrees between an operative position and a stowed position;
  - a retainer at or near a first axial end of the track, which retainer is movable between:
    - an inactive condition, in which the retainer permits a runner that is located at the first axial end of the track to move towards the second axial end of the track; and
    - an active condition, in which the retainer prevents a runner that is located at the first axial end of the track from moving towards the second axial end of the track; and
  - a formation that configures the retainer from:
    - the inactive condition to the active condition when the track is rotated from either the operative position or the stowed position; and
    - the active condition to the inactive condition when the track is in the operative position or the stowed position.

Typically:

- the track is linear; and
- the axis of rotation about which the track rotates relative to the shell intersects the track substantially midway between the first and second axial ends of the track.

Generally, the retainer comprises a tab that is movable between:

- a recessed position in which the tab does not protrude sufficiently into the track to inhibit movement of the runner from the first axial end of the track, past the tab and towards the second axial end of the track; and
- a protruding position in which the tab protrudes sufficiently into the track to prevent movement of the runner from the first axial end of the track, past the tab.

Preferably, either the runner or the tab defines a chamfered portion that facilitates movement of the tab from the protruding position to the recessed position as the runner moves from the first axial end of the track towards the second axial end of the track, abuts the tab and travels over the tab.

Typically, the tab is biased towards the protruding position.

Generally, the formation comprises an arcuate rail that:

- is fixed in position relative to the shell; and
- is sized and shaped to bear against the tab when the track is an intermediate position that is angularly displaced from both the operative position and the stowed position, thereby to prevent the tab from moving from the active condition to the inactive condition.

Preferably, the arcuate rail extends at a constant radius from the axis of rotation about which the track rotates relative to the shell.

BRIEF DESCRIPTION OF THE DRAWINGS

The invention will now be described in more detail, by way of example only, with reference to the accompanying drawing in which.

DESCRIPTION OF THE INVENTION

With reference to FIGS. 1 to 9, a helmet 10 according to a preferred embodiment of the invention includes: a shell 12, a chin guard 14 and a connector 16 for connecting the chin guard 14 to the shell 12.

The shell 12 is a standard helmet shell sized and shaped to receive a user's head therein.

The chin guard 14 is generally U-shaped and is sized to extend about a user's chin/lower jaw. The chin guard 14 may include a skirt (not shown) that is made of a flexible material and extends from the operative bottom edge of the chin guard 14.

Figure 1:
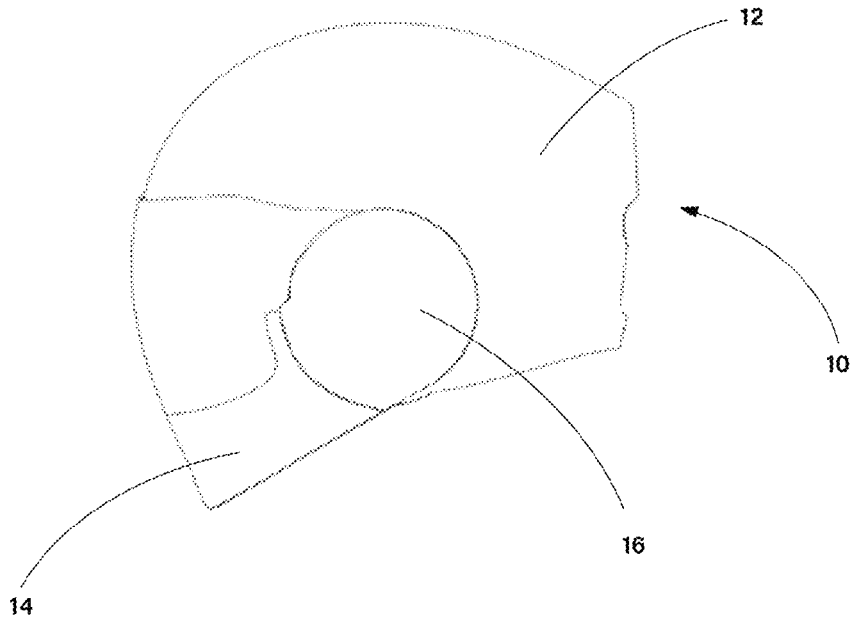
FIG. 1 is a side view of a helmet according to a preferred embodiment of the invention, with a chin guard in an operative retracted condition.
Figure 2:
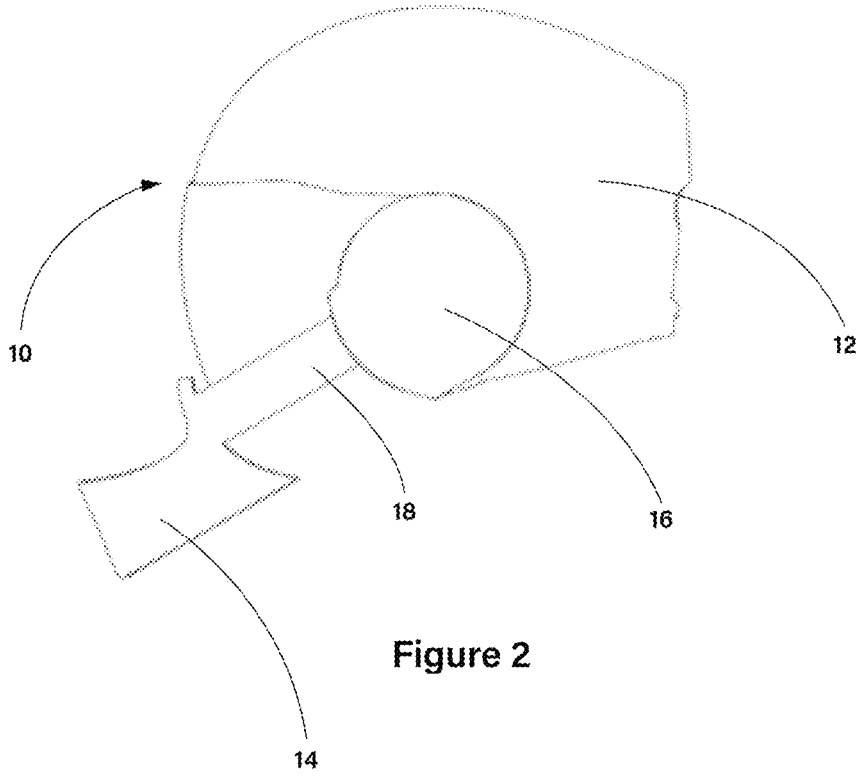
FIG. 2 is a side view of the helmet in FIG. 1, with the chin guard in an operative extended condition.
Figure 3:
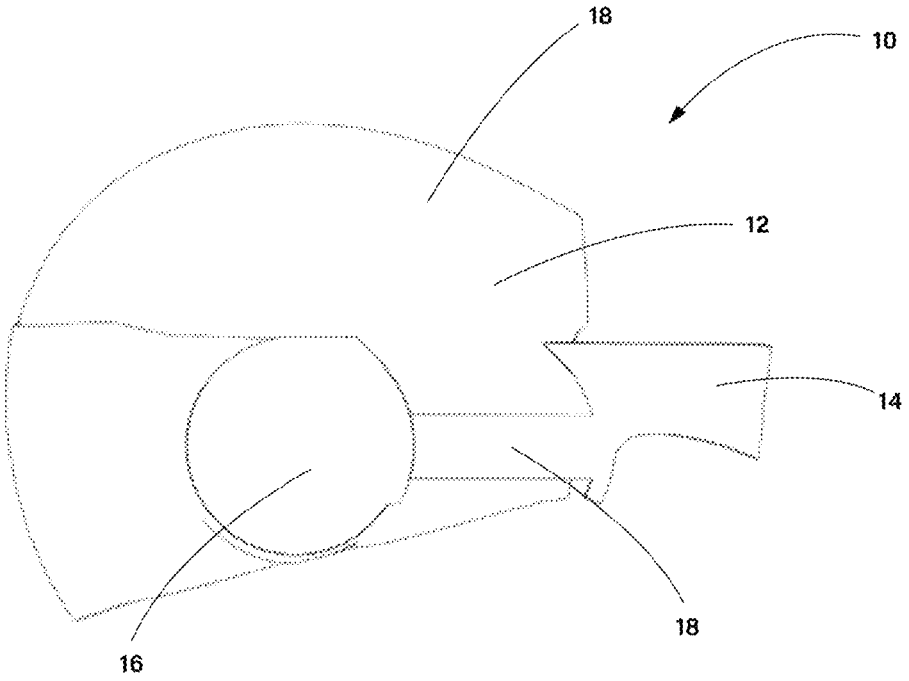
FIG. 3 is a side view of the helmet in FIG. 1, with the chin guard in a stowed extended condition.
Figure 4:
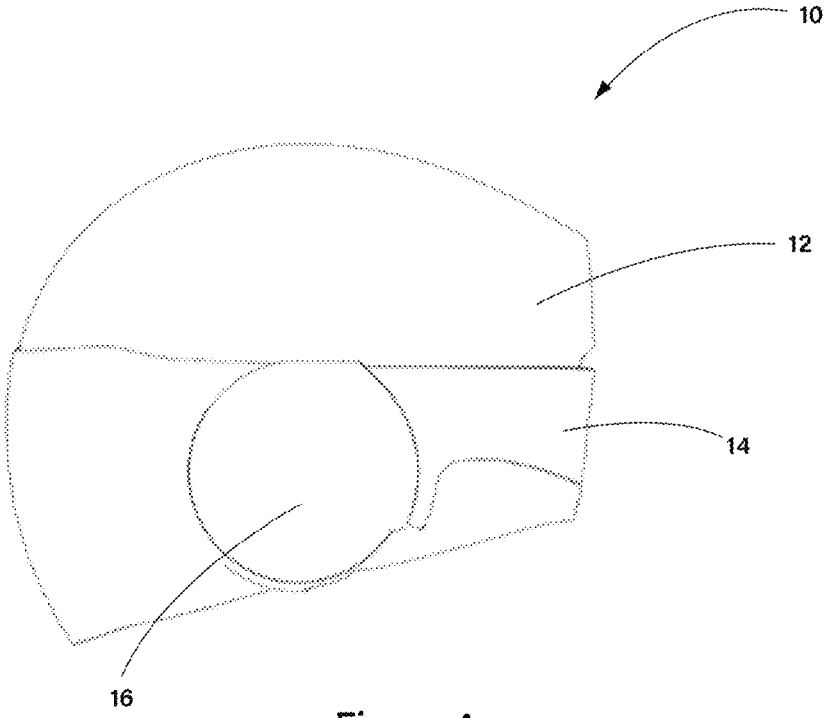
FIG. 4 is a side view of the helmet in FIG. 1 with the chin guard in a stowed retracted condition.
Figure 5:
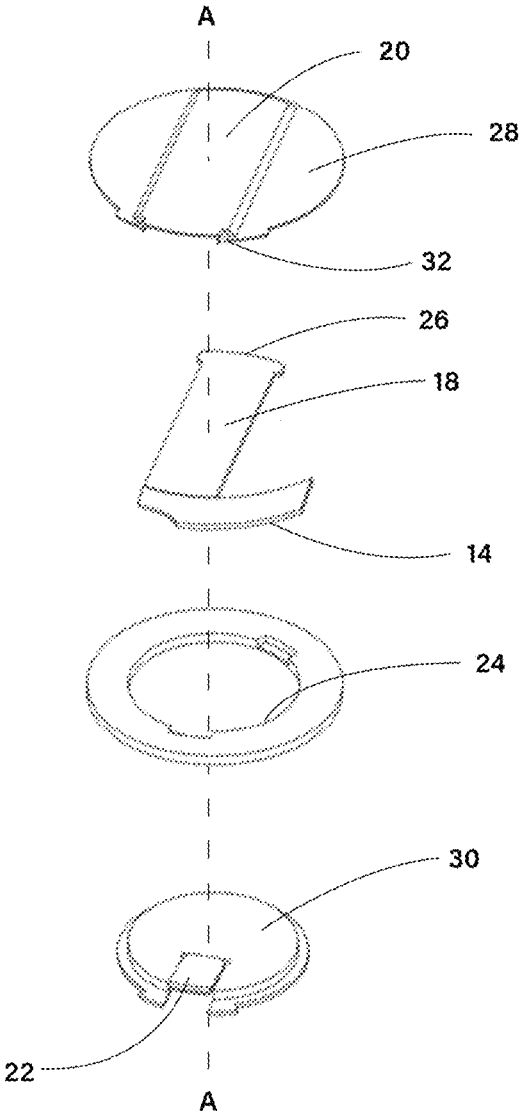
FIG. 5 is an upper perspective exploded view of a connector on the helmet in FIG. 1, which connector connects the helmet chin guard to the helmet shell.
Figure 6:
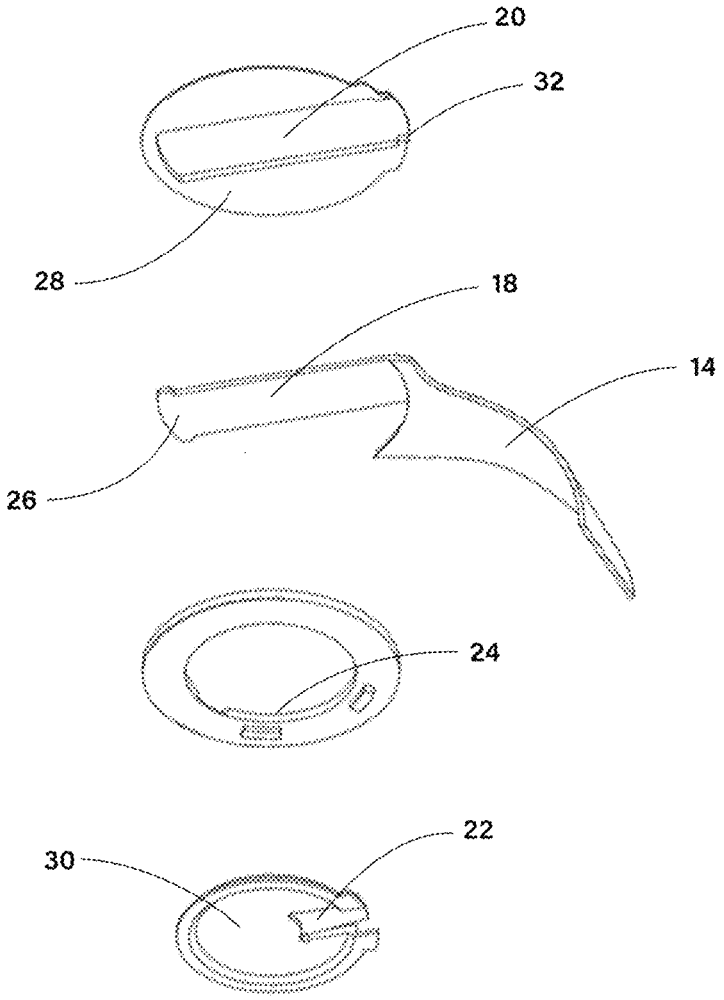
FIG. 6 is a lower perspective exploded view of the connector in FIG. 5.
Figure 7:
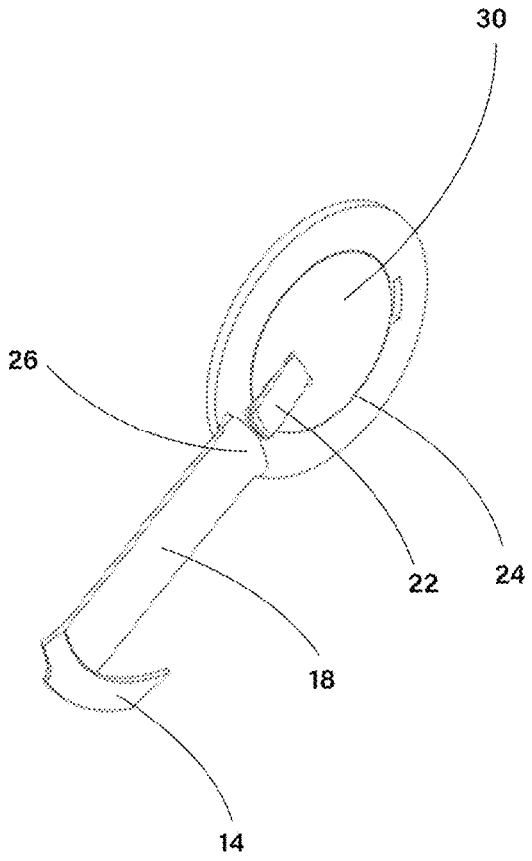
FIG. 7 is a perspective view of a portion of the connector in FIG. 5, with a track in an operative position and a chin guard runner at a first axial end of the track.
Figure 8:
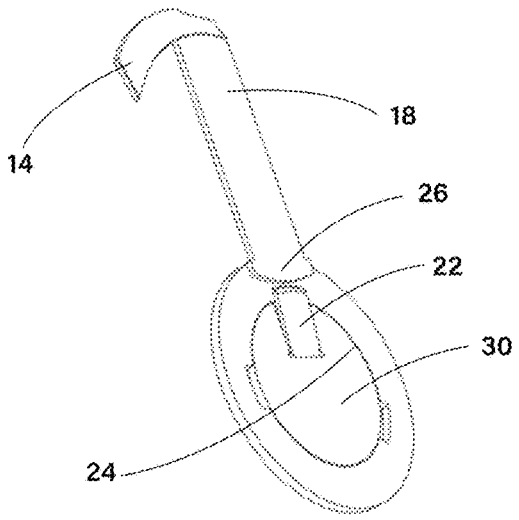
FIG. 8 is a perspective view of the portion of the connector in FIG. 5, with the track angularly displaced from the operative position and the chin guard runner at the first axial end of the track.
Figure 9:
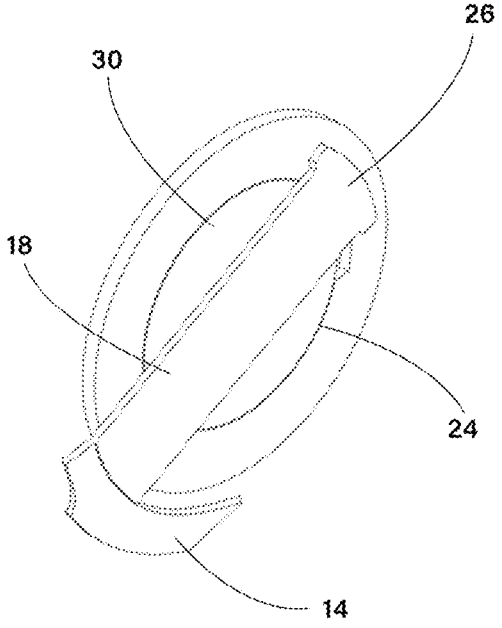
FIG. 9 is a perspective view of the portion of the connector in FIG. 5, with the chin guard runner at a second axial end of the track.

The connector 16 provides for both relative rotation and translation of the shell 12 and chin guard 14. More specifically, the connector 16 enables the chin guard 14 to move relative to the shell 12 between:

an operative retracted condition shown in FIG. 1;

an operative extended condition shown in FIG. 2;

a stowed extended condition shown in FIG. 3; and a stowed retracted condition shown in FIG. 4.

A connector 16 connects each end of the chin guard 14 to the shell 12.

Turning specifically to FIGS. 5 to 9, the connector 16 comprises: a runner 18 on the chin guard 14; a track 20; a retainer 22 (in the form of a tab); and a formation 24 (in the form of an arcuate rail).

The runner 18 is a linear elongate body that: extends from each end of the chin guard 14 and terminates in an enlarged head 26.

The track 20 is an enclosed linear track, primarily formed by:

- a cover cap 28, which defines an elongate linear groove there along; and
- a generally planar plate 30 that encloses the track 20, leaving only one axial end of the track 20 (i.e. a first axial end of the track 20) open to receive the runner 18 with enlarged head 26 there through.

The track 20 (i.e. the groove defined by the cover cap 28 is sized and shaped to permit the runner 18 to travel along the track 20 between the first and second axial ends of the track 20.

The open axial end of the track 20 defines a constriction 32 that is undersized relative to the enlarged head 26 of the runner 18, thereby to capture the enlarged head 26 of the runner 18 within the track 20.

The cover cap 28 and the plate 30 are fixed against relative rotation.

The cover cap 28 and plate 30 are rotatably mounted to the shell 12 to permit the cover cap 28, plate 30 and track 20 defined thereby to rotate relative to the shell 12 about an axis of rotation A-A through at least 120 degrees, preferably through 210 degrees, with the limits of the range of rotation referred to as "the operative position" (i.e. where the track 20 is oriented at 0 degrees of the range) and the "stowed position" (i.e. where the track 20 is oriented at 120 degrees (preferably 210 degrees) of the range). The track 20 is unable to rotate beyond the operative and stowed positions.

The axis of rotation A-A passes through the track 20, midway between the first and second axial ends of the track 20.

When the track 20 is in the operative position, the chin guard 14 is in the operative condition (shown in FIGS. 1 and 2), covering a user's chin.

When the track 20 is in the stowed position, the chin guard 14 is in the stowed condition, overlying the shell 12, as shown in FIGS. 3 and 4.

The retainer 22 is shown as a tab formed by the plate 30. The tab 22 is disposed near the first axial end of the track 20, and is movable between: a protruding position, in which the tab 22 protrudes from the surrounding surface of the plate 30 into the track 20 (i.e. into the groove defined by the cover cap 28); and a recessed position, in which the tab 22 does not protrude materially from the surrounding surface of the plate 30. The tab 22 is biased towards the protruding position.

The tab 22 is at or near the first axial end of the track 20. Preferably, the tab 22 is spaced from the constricted 32 open axial end of the track 22 by a distance corresponding to the length of the enlarged head 26 of the runner 18. Accordingly, when the runner 18 is fully extended with the runner 18 enlarged head 26 abutting the constriction 32, the enlarged head 26 is bounded by: the groove 20 defined by the cover cap 28 on the sides of the enlarged head 26; the constriction 32 at a proximal end of the enlarged head 26; and the protruding tab 22 at a distal end of the enlarged head 26 (as partly shown in FIGS. 7 and 8).

It will be appreciated that, when the enlarged head 26 of the runner 18 is located at the first axial end of the track 22, for as long as the tab 22 is maintained:

- in the protruding position, the tab 22 protrudes sufficiently into the track 22 to prevent the runner's 18 enlarged head 26 (and, therefore the runner 26) from moving past the tab 22 towards the second axial end of the track 22; and
- in the recessed position, the tab 22 does not protrude sufficiently into the track 20 to inhibit movement of the runner 18 from the first axial end of the track 20, past the tab 22 and towards the second axial end of the track 20.

To facilitate movement of the tab 22 from the protruding position to the recessed condition, the free end of the tab 22 and/or the free end of the enlarged head 26 are chamfered, which chamfered portion(s) cause the tab 22 to move from the protruding position to the recessed position as the enlarged head 26 abuts and rides over the tab 22. When the tab 22 is in the recessed position, the runner 18 is free to move from the first axial end of the track 20 to the second axial end of the track 20.

The formation 24 comprises an arcuate rail that is fixed in position relative to the shell. In other words, the arcuate rail 24 and the shell 12 are fixed against relative rotation. The arcuate rail 24 extends at a constant radius from the axis of rotation A-A, and is sized and shaped to be received operatively underneath the tab 22 (i.e. between the tab 22 and the surrounding plate 30) when the tab 22 is in the protruding position, thereby to jam the tab 22 in the protruding position. The arcuate rail 24 extends through an angle (determined about the axis of rotation A-A) that is less than the angular displacement of the track 20 between the operative and stowed positions. Accordingly, when:

the track 20 is in either the operative position or the stowed position, the arcuate rail 24 does not extend operatively underneath the protruding tab 22, permitting the tab 22 to be pushed from the protruding position to the recesses position as the runner 18 (with enlarged head 26) abuts and rides over the tab 22. This configuration is referred to as the "inactive condition", i.e. the condition in which the tab 22 permits a runner 18 located at the first axial end of the track 20 to move towards the second axial end of the track 20.

The track 20 is angularly displaced from either the operative position or the stowed position (i.e. is moved to an intermediate position between the operative and stowed positions) with the runner's 18 enlarged head 26 at the first axial end of the track 20 and the tab 22 in the protruding position, the tab 22 rides over the arcuate rail 24, receiving the arcuate rail 24 between the operative underside of the tab 22 and the surrounding plate 30. With the arcuate rail 24 received operatively beneath the tab 22 and bearing against the tab 22, the arcuate rail 24 jams/prevents the tab 22 from moving from the protruding position to the recessed position. This configuration is referred to as the "active condition", i.e. the condition in which the arcuate rail 24 prevents a runner 18 located at the first axial end of the track 20 from moving towards the second axial end of the track 20.

It will be appreciated that the connector 16 permits independent rotation and translation of the chin guard 14 relative to the shell 12. In other words, the chin guard 14 is able to be moved between the retracted and extended operative conditions while the chin guard 14 does not rotate relative to the shell 12. More specifically, it will be appreciated that, while the chin guard 14 is moved between the retracted and extended operative conditions, relative rotation of the chin guard 14 and the shell 12 is restricted. Furthermore, by permitting the runner 18 to move along the rail 20 beyond the axis of rotation A-A, the chin guard 14 may be retracted a greater degree than most other prior art retractable chin guards.

The invention claimed is:

1. A helmet including:

a shell;

a chin guard;

a runner on the chin guard; and a connector for pivotally securing the chin guard to the shell, the connector including:

a track that:

is sized to permit the chin guard runner to travel there along; and is rotatably connected to the shell about an axis of rotation, such that the track is able to rotate relative to the shell through at least 120 degrees between an operative position and a stowed position;

a retainer at or near a first axial end of the track, which retainer is movable between:

an inactive condition, in which the retainer permits a runner that is located at the first axial end of the track to move towards the second axial end of the track; and an active condition, in which the retainer prevents a runner that is located at the first axial end of the track from moving towards the second axial end of the track; and a formation that configures the retainer from:

the inactive condition to the active condition when the track is rotated from either the operative position or the stowed position; and the active condition to the inactive condition when the track is in the operative position or the stowed position.

2. The helmet according to claim 1, wherein:

the track is linear; and the axis of rotation about which the track rotates relative to the shell intersects the track substantially midway between the first and second axial ends of the track.

3. The helmet according to claim 2, wherein the retainer comprises a tab that is movable between:

a recessed position in which the tab does not protrude sufficiently into the track to inhibit movement of the runner from the first axial end of the track, past the tab and towards the second axial end of the track; and a protruding position in which the tab protrudes sufficiently into the track to prevent movement of the runner from the first axial end of the track, past the tab.

4. The helmet according to claim 3, wherein either the runner or the tab defines a chamfered portion that facilitates movement of the tab from the protruding position to the recessed position as the runner moves from the first axial end of the track towards the second axial end of the track, abuts the tab and travels over the tab.

5. The helmet according to claim 4, wherein the tab is biased towards the protruding position.

6. The helmet according to claim 5, wherein the formation comprises an arcuate rail that:

is fixed in position relative to the shell; and is sized and shaped to bear against the tab when the track is an intermediate position that is angularly displaced from both the operative position and the stowed position, thereby to prevent the tab from moving from the active condition to the inactive condition.

7. The helmet according to claim 6, wherein the arcuate rail extends at a constant radius from the axis of rotation about which the track rotates relative to the shell.

* * * * *